US005662558A

United States Patent [19]

Shannon, III

[11] Patent Number: 5,662,558

[45] Date of Patent: Sep. 2, 1997

[54] WATER STREAM GENERATOR

[76] Inventor: Byron T. Shannon, III, 1371 Stokes Rd., Medford, N.J. 08055

[21] Appl. No.: 690,325

[22] Filed: Jul. 25, 1996

[51] Int. Cl.[6] ..... F04F 5/02

[52] U.S. Cl. ..... 482/55; 4/488; 4/491

[58] Field of Search ..... 4/488, 495, 492, 4/494, 497, 496, 541.1–541.6; 405/79; 482/55, 56

[56] References Cited

U.S. PATENT DOCUMENTS

| | | | |
|---|---|---|---|
| 1,630,797 | 5/1927 | Marwick . | |
| 3,534,413 | 10/1970 | Plasseraud . | |
| 4,561,133 | 12/1985 | Laing . | |
| 4,665,572 | 5/1987 | Davidson et al. . | |
| 5,186,578 | 2/1993 | Perslow | 4/491 |
| 5,226,747 | 7/1993 | Wang et al. | 4/491 |
| 5,298,003 | 3/1994 | Weihe et al. . | |
| 5,478,208 | 12/1995 | Kasai et al. | 4/491 |

OTHER PUBLICATIONS

Brochure entitled "SwimEx complete Aquatic Therapy Systems," publication date unknown, but acknowledged to be prior art.

Brochure entitled "SwimEx Exercise without compromise in the convenience of your home," publication date unknown, but acknowledged to be prior art.

Brochure entitled "Swim Gym Pumps," with price list dated Mar. 15, 1992.

Advertisement for Speck Pumps, publication date unknown, but acknowledged to be prior art.

Publication entitled "Hot Water News," vol. 2, No. 1, Byron Shannon III, editor, publication date unknown, but acknowledged to be prior art.

Aqua Trainer illustration, publication date unknown, but acknowledged to be prior art.

*Primary Examiner*—Jerome Donnelly
*Assistant Examiner*—Glenn E. Richman
*Attorney, Agent, or Firm*—Synnestvedt & Lechner

[57] ABSTRACT

A portable device for generating water current in a swimming pool is disclosed. The purpose is to provide a current against which a person can swim, for exercise or for pleasure. The invention provides an anti-cavitation plate for the suppression of whirlpool currents and the smoothing out of the bulge and waves which normally occur downstream of the propeller and preferably also includes a multi-finned enclosure housing the motor and propeller and providing for the encouragement of the development of laminar flow in the stream exiting from the device for use by the swimmer.

14 Claims, 6 Drawing Sheets

FIG. 5
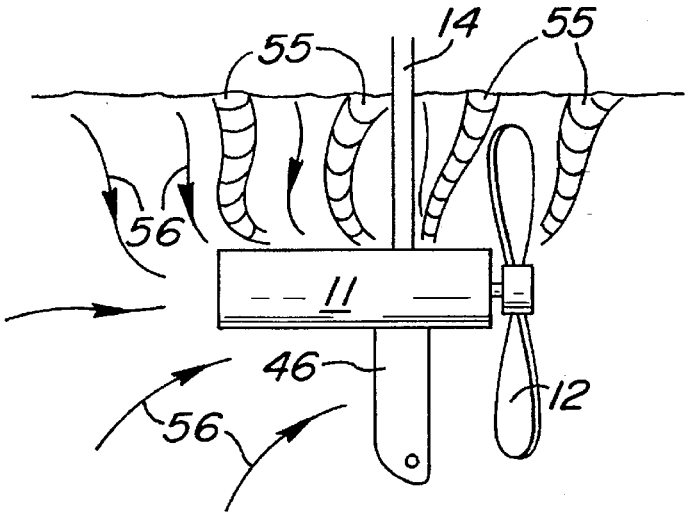
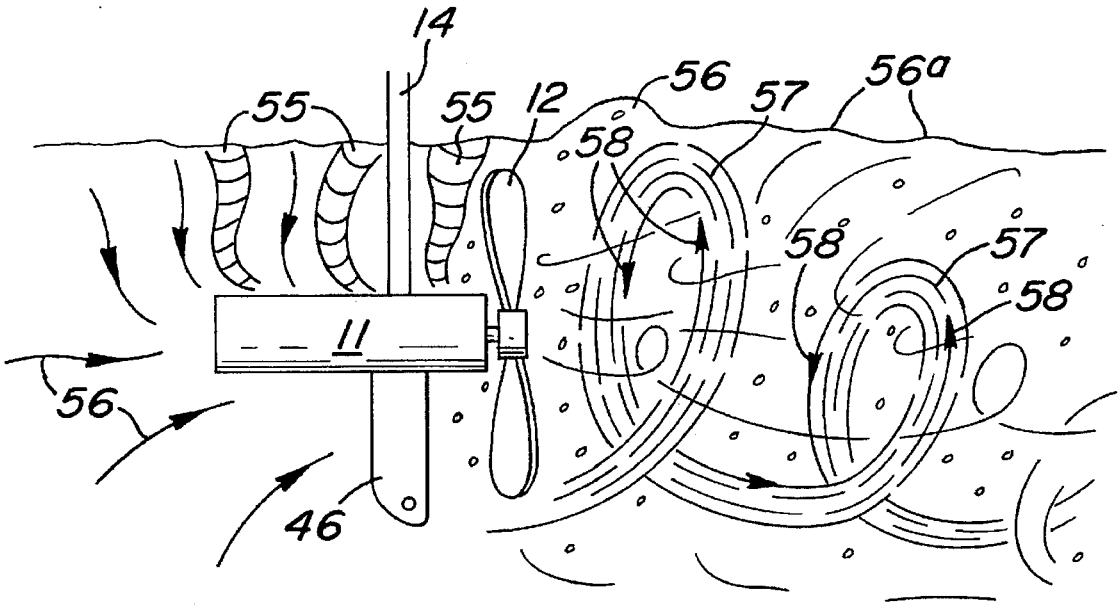
FIG. 6

FIG. 7
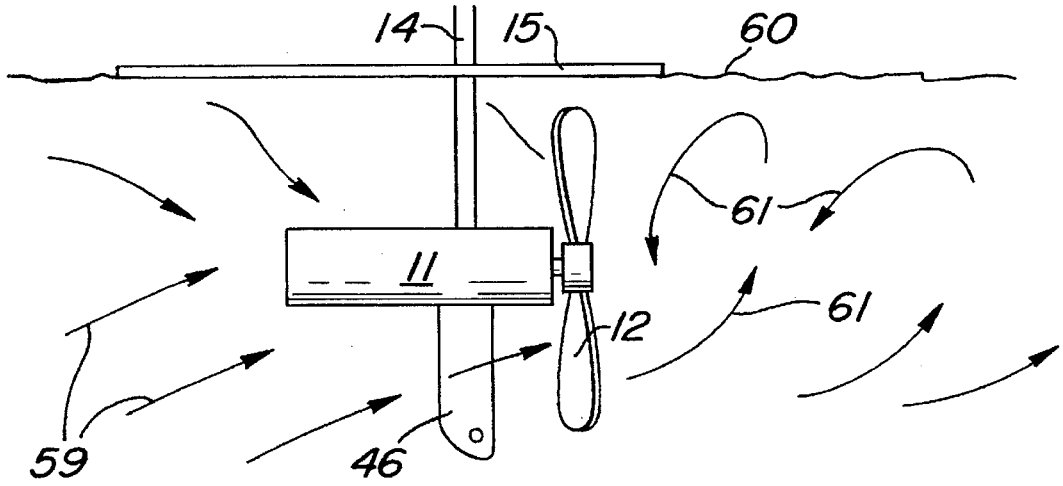
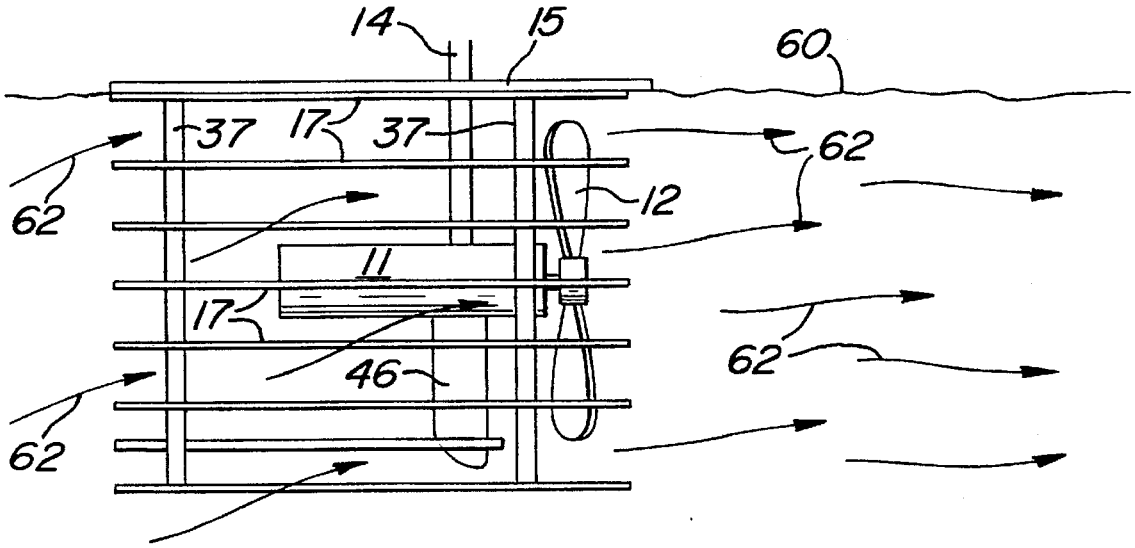
FIG. 8

WATER STREAM GENERATOR

This invention relates to preferably portable devices for generating a water current in a swimming pool against which current a person can swim, for exercise, or just for pleasure.

BACKGROUND OF THE INVENTION

Devices for generating a current of water in a swimming pool have been heretofore known but, in general, they require relatively complicated and expensive modifications to the walls of a swimming pool in order to accommodate the installation of cumbersome and expensive permanent equipment for generating currents in the water of the pool. Such portable devices as there have been heretofore generally suffer from inadequate performance in that they generate a more or less vigorously turbulent stream traveling in a helical path rather than the desired stream which is in a substantially laminar flow pattern, that is, smooth and steady and along the surface of the water where a swimmer can easily and conveniently get out into the stream and swim against it.

Generating a current or stream flow with traditional swimming pool pumps is inefficient and costly. Pumps and associated plumbing can represent a very large factor in the cost of the installation. The water current produced by this type of pump is not appealing because of its turbidity and abundance of bubbles. The electrical cost is tremendous and the overall service attention is high. Several water nozzle designs are offered by the prior art with different size pumps, but the end result is disappointing. The "paddle wheel" concept is an improvement but is much more expensive. As a result, stream flow pools or swim spas have not gained popularity or market share. Existing pools cannot be adapted for their use.

Until now there has been no alternative source of design that could supply a stream flow "current" that is smooth, clear and resembles flat water swimming but this result is achieved by the device of the invention.

SUMMARY OF THE INVENTION

The invention provides a simple and inexpensive device perferably portable, for generating a water current in a swimming pool having a motor driving a propeller mounted on the shaft thereof, the motor and propeller being supported by the device below the water level in the swimming pool in proximity to a wall of the swimming pool and oriented so that the propeller is facing in a direction to generate a stream of water flowing away from the wall and substantially along the surface region of the water.

The invention provides an anti-cavitation plate which is mounted so as to have at least its lower surface immersed in the pool water, substantially parallel to the water surface, in a position where it can influence the path of travel of the stream of water generated by the propeller. The anti-cavitation plate has a portion mounted in a region generally above the suction side of the propeller, which portion is wide enough transversely of the stream of water being generated so as to prevent substantially the formation of whirlpool currents which otherwise tend to form immediately and feed air bubbles into the suction side of the propeller during rotation. Such air bubbles are undesirable because they cause frothing and diminish the strength of the desired current of water.

The anti-cavitation plate has another portion mounted in the region generally downstream of the propeller, which portion is long enough, in the direction of the stream exiting from the propeller, so as to prevent substantially the formation of the characteristic bulge in the water level just downstream of the propeller, followed by lumpy waves as the stream progresses downstream from the propeller. Such bulge and lumpy water are undesirable because they interfere with the swimmer's convenient use of the stream and because they indicate turbulence rather than laminar flow.

In the preferred embodiment, the anti-cavitation plate has a portion, as above noted, above the suction side of the propeller which has substantially parallel side walls, and a delta-shaped portion on the downstream end pointed in the downstream direction, the two portions being smoothly interconnected and of a size and shape to accomplish both the objectives of the anti-cavitation plate, namely the suppression or elimination of substantially all of the whirlpool currents otherwise forming on the suction side of the propeller and the suppression or elimination of the bulge and rough water downstream of the propeller.

In a preferred form in the preferred embodiment, the invention provides, in addition to the anti-cavitation plate, means associated with the motor and propeller for influencing the water flowing under the action of the propeller toward a substantially laminar flow pattern, thereby minimizing helical and turbulent flow of the stream downstream of the propeller. The means can conveniently be in the form of a cage-like housing substantially surrounding but spaced from the propeller, the housing including a multiplicity of spaced, parallel horizontal fins constructed and arranged so as to influence the water flowing under the action of the propeller toward a substantially laminar flow pattern.

BRIEF DESCRIPTION OF THE DRAWINGS

FIG. 5 is a fragmentary elevation of a motor and propeller, omitting all other apparatus, and indicating the pattern of whirlpools which forms when the propeller is turned on, which whirlpools feed air bubbles into the suction side of the propeller;

FIG. 6 is a view similar to FIG. 5 but showing, in addition, the general pattern of flow downstream of the propeller, this being highly turbulent and helical and exhibiting a sizable bulge just downstream of the propeller;

FIG. 7 is a view similar to FIG. 5 but having in place an anti-cavitation plate according to the invention, with the result that the whirlpool streams of bubbles and the bulge of water just downstream of the propeller are substantially eliminated; and FIG. 8 adds to the structure of FIG. 7, which includes the anti-cavitation plate, the multiplicity of fins structure which forms a cage housing the propeller and motor, this view showing the elimination by the anti-cavitation plate of the whirlpools and the bulge downstream of the propeller; and also showing the substantial damping of the helical and turbulent flow pattern downstream of the propeller and the substitution of the substantially laminar flow pattern of the water stream downstream from the propeller.

DETAILED DESCRIPTION OF THE EXEMPLARY AND PREFERRED EMBODIMENTS

Figure 1:
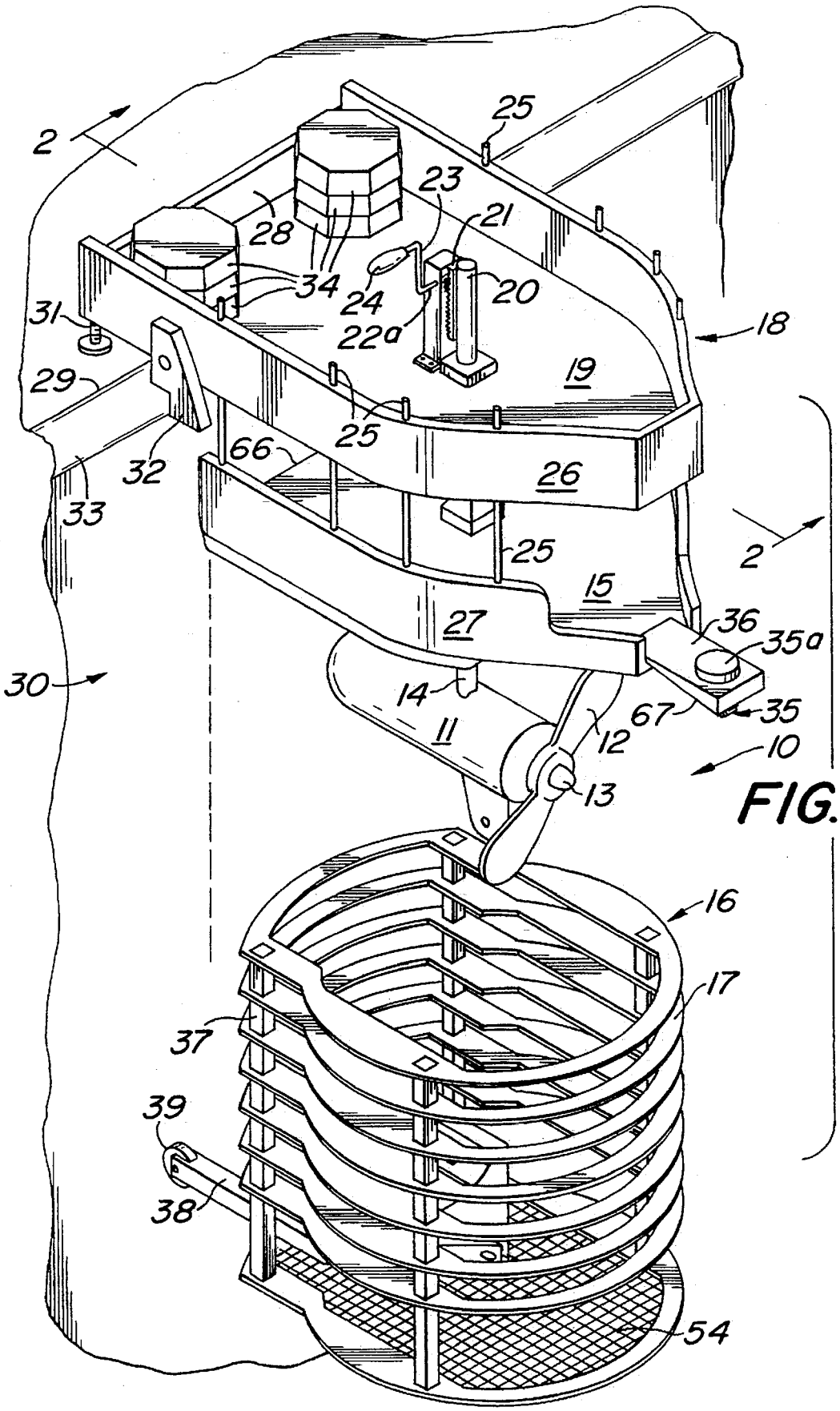
FIG. 1 is an exploded perspective view of the equipment of the invention with the cover removed.

In FIG. 1, a first assembly of parts 10 comprises a motor 11 having a propeller 12 mounted on the shaft 13, the motor being supported on the support bar 14 which passes upwardly through an anti-cavitation plate 15, and a cage-like structure 16 surrounding the motor and propeller consisting of a multiplicity of horizontal narrow fins 17 mounted parallel to each other and spaced apart a distance small enough to preclude the possibility of a person reaching their hand through the space between adjacent fins and thus into proximity to the whirling propeller.

Figure 2:
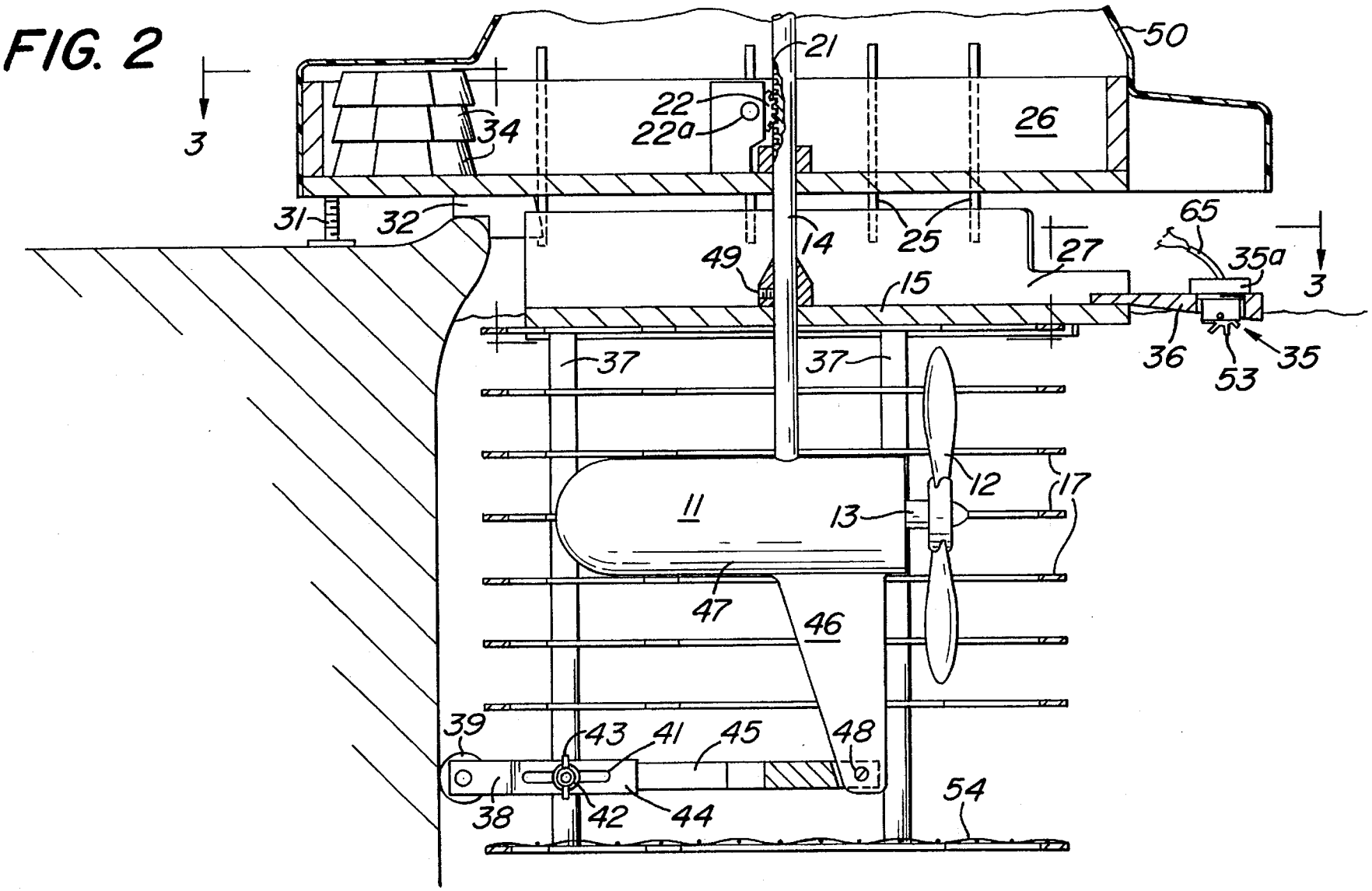
FIG. 2 is a sectional elevation, on a larger scale than FIG. 1, taken along the line 2—2 of FIG. 1.

The first assembly of parts 10 is suspended below a second assembly of parts 18, having a top plate 19 of the general shape and size of the anti-cavitation plate 15, with the motor support bar 14 projecting upwardly therethrough and terminating at the upper end 20 where it carries a rack 21 meshing with a pinion 22 (see FIG. 2), which pinion is mounted on the shaft 22a of adjustment crank 23 having a handle 24 which, when rotated, manually rotates the pinion 22 and changes the vertical position of the pinion and thus the motor support bar 14.

The anti-cavitation plate 15 and the top plate 19 are mounted together by means of spindles 25 passing through holes in the upstanding flange 26 of the top plate 19 and into holes drilled in the upstanding flange 27 on the peripheral edge of the anti-cavitation plate 15.

Continuing the description of the second assembly, the top plate 19 extends at the rear end 28 over the lip or side edge 29 of a pool generally shown at 30. The rear end of the top plate 19 is supported by adjustable legs 31 and notched holder 32 which is notched so as to firmly abut the top edge 33 of the pool wall, thus positioning the entire unit with relation to the pool side and the water. A plurality of weights 34 can be placed on the top plate 19 in the region of the rear end 28 so that the weights rest against the pool apron and maintain the assembly of the invention in place.

A water stream velocity measuring device 35, having a cap **35*a*, is mounted on the projection 36 from the front end of the anti-cavitation plate 15**.

Figure 3:
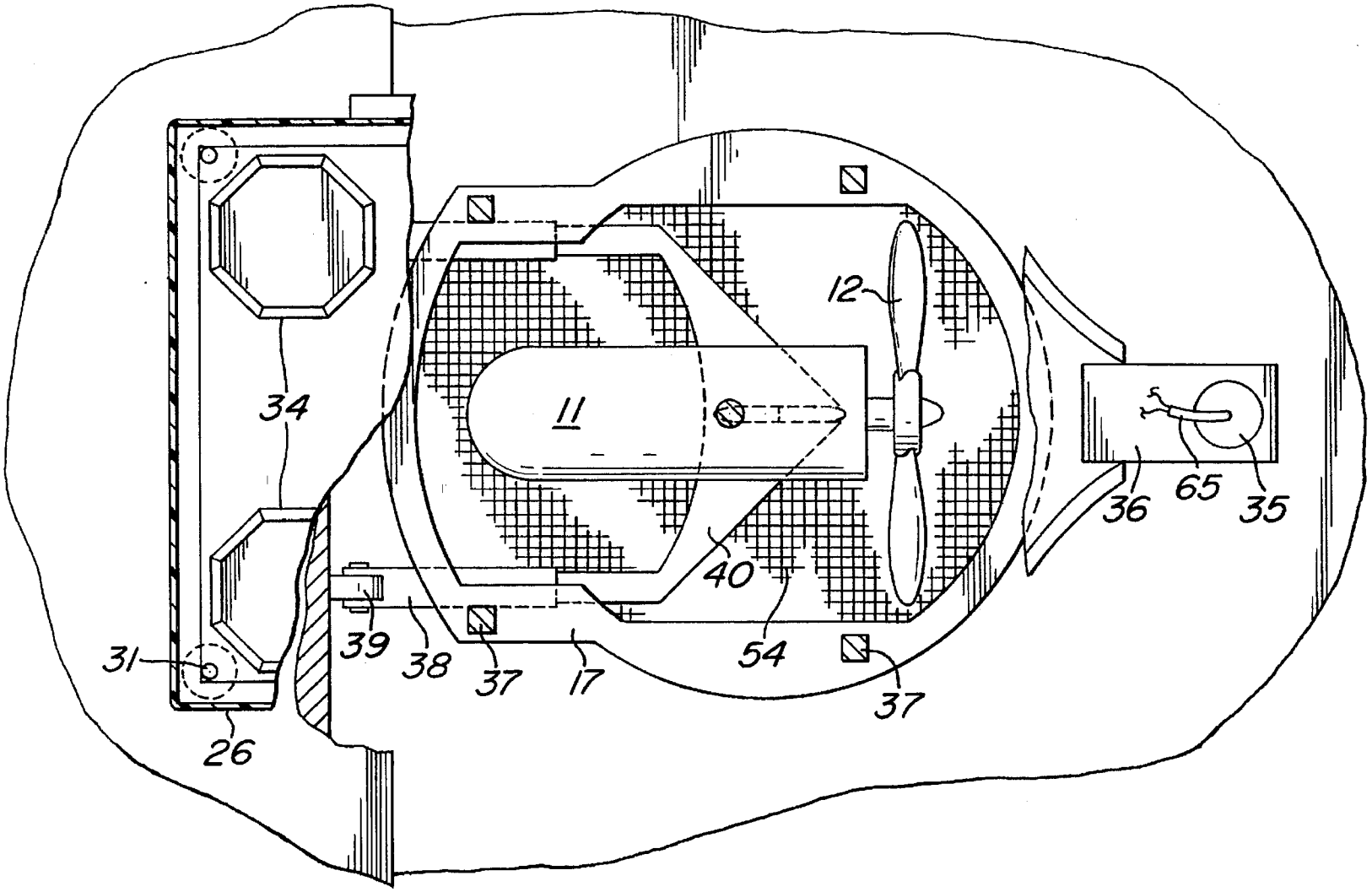
FIG. 3 is a plan section taken generally along the line 3—3 of FIG. 2.

The multiplicity of fins 17 are mounted in spaced relation to each other by means of square, tubular, vertical posts 37. Thrust bars 38 terminating in a wheel 39 are mounted on a yoke 40 (see FIG. 3) so as to provide reaction points against which the thrust of the propeller can be deployed. A slot 41 and associated slider 42 having a thumb nut 43 (see FIG. 2) provides for adjustment of the telescoping members 44, 45 of the thrust bars 38, thereby providing for accommodation of pool side walls of various configurations without distortion or strain on the mounting mechanism of the motor.

The bottom screen 54 is provided over the bottom of the cage within which the propeller and motor are housed, the screen being of mesh small enough to prevent human fingers from being inserted into the path of the propeller.

The bar 14 supporting the motor is conveniently hollow to accommodate electrical wires passing therethrough to interconnect the motor with a battery pack (see 52 in FIG. 4) which sits at the pool side near the device of the invention. The motor is preferably a variable speed motor and by adjustment of a control mechanism (not shown) the speed of the motor, and thus the propeller, can be selected, with relation to the desired water generated speed, so as to provide the swimmer with the desired stream speed against which to swim. Low water speeds are indicated for children and for adults who are not strong swimmers or who want to "take it easy". Water speed can be increased with increased strength of the swimmer or the swimmer's desire to swim more rapidly to increase the heart rate of the swimmer and provide more vigorous exercise.

The motor mounting leg 46 extends downwardly from the housing of the motor 47 to a pivot 48 mounted on the end of the telescoping members 44, 45 of the thrust bar 38. A set screw 49 can be tightened to adjustably fix the position of the anti-cavitation plate 15 with relation to the motor shaft mount 14.

A cover 50 (see FIG. 4) surmounts the whole apparatus and gives it a pleasing appearance as well as protecting it. An electrical cable 51 leads to a battery pack 52 for operating the motor, the other end of the cable 51 passing downwardly through the motor support bar 14 to the motor itself.

Wires 65 (see FIG. 2) pass upwardly through the cap **35*a* of the water stream speed measuring mechanism 35 and outwardly to a stream speed indicating device (not shown). The water wheel 53** spins at a rate of speed directly proportional to the speed of the stream of water exiting downstream of the propeller and this provides for the indication of the water speed needed so as to control and adjust the motor speed to the desired level.

Attention is now turned to FIGS. 5, 6, 7 and 8. FIGS. 5 and 6 illustrate the phenomena substantially overcome by the use of the anti-cavitation plate of the invention. FIG. 5 shows a motor 11 mounted on leg 46 and bar 14 and having a propeller 12 mounted on the motor drive shaft. With the propeller in rotation, the whirlpool currents 55 tend to form very quickly, sucking air bubbles downwardly into the suction side of the propeller where they are entrained in the water flowing into the suction side, as indicated by the arrows 56.

In FIG. 6, the whirlpool phenomena is illustrated again, as in FIG. 5, but the accompanying phenomena, namely, the highly turbulent, helical water flow downstream from the propeller with the inevitable bulge 56 which characteristically forms just downstream of the propeller, and the relatively rough waves downstream **56*a*, the helical water flow being indicated by the lines 57 and the arrows 58**.

FIG. 7 shows the beneficial effect of providing the anti-cavitation plate 15 of the invention. The water flow into the suction side of the propeller occurs somewhat more fulsomely from the lower levels of the water and less from the surface water, as indicated by the arrows 59. The water surface 60 downstream of the propeller does not have a bulge such as shown at 56 in FIG. 6, and is relatively smooth. The anti-cavitation plate must be of width crosswise of the stream sufficient to substantially eliminate the generation of whirlpool bubble currents and the anti-cavitation plate must extend downstream of the propeller a sufficient distance to suppress the formation of the bulge in the water and the rough water downstream thereof.

However, as noted by the arrows 61, the flow downstream of the propeller still tends to be helical.

As shown in FIG. 8, the addition of not only the anti-cavitation plate 15, but also the multiplicity of horizontal fins 17 overcomes the phenomena of the helical water flow downstream of the propeller and provides for substantially laminar flow as indicated by the arrows 62.

Thus, the preferred combination includes both the anti-cavitation plate and the multiplicity of fins and constitutes the best mode known to the inventor for carrying the invention into practice. However, as demonstrated by FIGS. 5, 6 and 7, use of the anti-cavitation plate alone is highly advantageous even without the multiplicity of horizontal fins surrounding the propeller and motor.

By way of illustration but not limitation, the anti-cavitation plate 15 may be approximately 20 inches measured parallel with the stream flow, that is, from the back edge 66 (see FIG. 1) next to the pool wall to the front nose 67 adjacent the water stream speed measuring mechanism 35. The exact size and shape of the anti-cavitation plate depend on the size of the motor and the speed of operation thereof, but for the sizes of motor indicated herein, which have been found to provide swimming currents of a satisfactory range of speeds, it has been found that the anti-cavitation plate need not be longer than about 20 inches in direction parallel to the water flow. Transverse the water flow, at the widest part where the side walls are substantially parallel need not be quite as large as the indicated approximately 20-inch length, 18 inches being appropriate. The positioning of the anti-cavitation plate is important and, as shown, it is preferably positioned so that the motor support bar 14 passes approximately through the midpoint in both the longitudinal direction, that is, taken in the direction of the stream flow, and the cross-wise or lateral dimension, taken perpendicular to the stream flow. The anti-cavitation plate preferably has a thickness of about ⅜ inches to ⅝ inches, most preferably about ½ inch.

Figure 4:
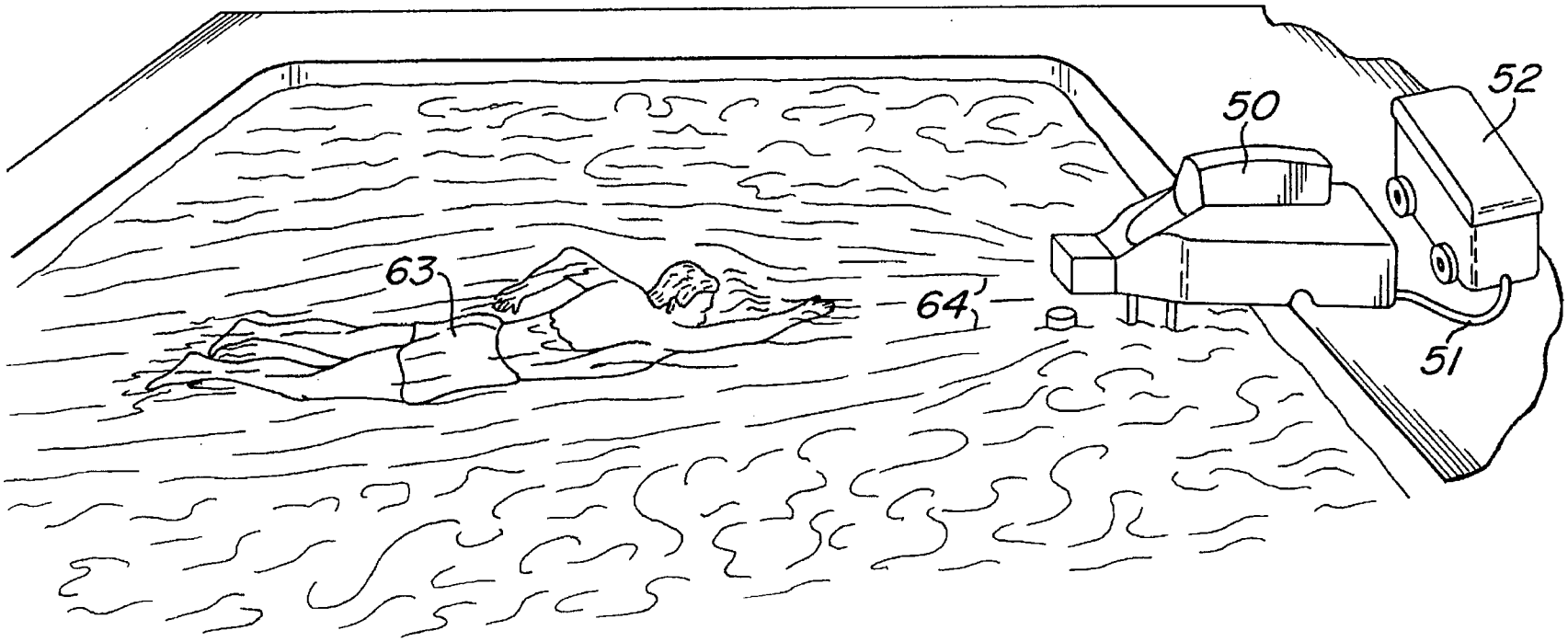
FIG. 4 is a general perspective of the invention mounted beside a pool in operating position and actually in operation with a swimmer swimming in the generated current.

FIG. 4 illustrates the equipment of the invention mounted at the side of a swimming pool, in operation, with a swimmer 63 swimming against the current indicated by the dashed lines 64. The current is steady and smooth and relatively laminar in its flow. It does not have a substantial proportion of entrained bubbles, it does not have the bulge and the ensuing rough surface downstream of the propeller, it does not flow in a helical path, but in a smooth, steady, substantially laminar flow path to and around the swimmer.

Because of the formation of the relatively smooth laminar flow stream, coupled with the wide range of speed possible by controlling the speed of rotation of the motor and propeller, the invention can be used for tension swim stroke, for swim training, for distance workout, for swim therapy, or just for pleasure swimming.

The equipment of the invention comprises a portable and self-contained stream generator which is small, compact, user-friendly and is easily operated by untrained persons with very little instruction. Use of the invention in one's aquatic environment allows one to swim in a confined area, perform aquatic exercise, develop a regulated therapy or just play. The benefits are many.

The current generated by the invention is sufficient for one or two people to swim against and perform aquatic exercises. Water velocity, distance travelled, time and swimmer's heart rate can be measured and logged. Inherent in the invention is remarkable versatility and, as a result, an ability to be used with nearly every above-ground and in-ground swimming pool. The invention is manufactured preferably from lightweight and strong fiber composites comprising fiber-reinforced synthetic resins and it has relatively few components. The energy pack is compact and complete and simple to operate. It includes a battery, a battery charger and connection plug-in cord. One power cord plugs into the cover of the invention. The battery pack provides a low voltage power source. The gel-type battery eliminates the hazard of leaking fluids.

It takes only several minutes to set up the invention ready for operation in a swimming pool.

EXAMPLES

Example 1

A swimming current generator according to the invention was assembled using a 31 lb. thrust motor. A 31 lb. thrust motor produces a wide range of speeds of water current flow, from about 2 mph to about 6 mph. It was found to give good performance for water aerobics, teaching children to swim, and novice swimmers.

Example 2

Another unit according to the invention was constructed using a 46 lb. thrust motor. This gave strong performance with a maximum current of about 8 mph. It developed a strong and swift current, resulting in a good workout for strong swimmers who wanted to develop endurance and better form.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

I claim:

1. A portable device for generating a water current in a swimming pool against which current a person can swim comprising, a motor having a propeller mounted on the shaft thereof, support means for supporting said motor below the water level in said swimming pool in proximity to a wall of said swimming pool and oriented with the propeller facing in direction to generate a stream of water flowing away from said wall and substantially along the surface region of the water, an anti-cavitation plate having at least its lower surface mounted immersed in the pool water substantially parallel to the water surface in a position to influence the path of travel of said stream and intermediate the water level and the top of the rotational path of the peripheral tips of the propeller blades, the anti-cavitation plate having a first portion mounted in a region generally above the suction side of the propeller, said first portion having generally parallel side edges and a width crossways of said stream of water sufficient to prevent substantially the formation of whirlpool currents feeding air bubbles into the suction side of the propeller during rotation thereof, the anti-cavitation plate having a length, taken parallel to said stream, sufficient to prevent substantially the formation of a current of water of said stream bulging upwardly above the normal pool water level downstream of the propeller during rotation thereof.

2. A device according to claim 1 in which the anti-cavitation plate is tapered to form a substantially delta shape pointing in the direction of flow of said stream of water.

3. A device according to claim 1 in which the anti-cavitation plate is submerged in the pool water.

4. A device for generating a water current in a swimming pool against which a person can swim comprising, generator means for generating a stream of water flowing in a given direction substantially along the surface region of the water, and an anti-cavitation plate mounted with at least its lower surface immersed in the water substantially parallel to the water surface in a position to influence the path of travel of said stream and intermediate the water level and the top of said generator means, the anti-cavitation plate having a width perpendicular to said given direction sufficient to prevent substantially the formation of whirlpool currents feeding air bubbles into said generator means, and having a length, taken in direction parallel to said given direction, sufficient to prevent substantially the formation of a current of water of said stream bulging upwardly above the normal water level downstream of the generator means.

5. A device according to claim 4 in which the generator means comprises a motor with a propeller mounted on the shaft thereof.

6. A device according to claim 5 in which the motor is mounted in adjustable relation to and below the anti-cavitation plate to form a first assembly, said first assembly being adjustably mounted below and dependent from a second assembly, said second assembly being mountable on the apron beside the swimming pool with the first assembly projecting downwardly over the edge of the pool and into the water, and adjustment means for adjusting the relative positions of the first and second assemblies with relation to the water level and with relation to each other.

7. A device according to claim 5 and further including a cage-like housing substantially surrounding but spaced from the propeller, said housing including a multiplicity of spaced, parallel horizontal fins constructed and arranged so as to influence the water flowing under the action of the propeller toward a substantially laminar flow pattern, thereby minimizing helical and turbulent flow of said stream downstream of the propeller.

8. A device according to claim 4 in which the anti-cavitation plate comprises fiber reinforced synthetic resin.

9. A device according to claim 6 in which the first and second assemblies comprise fiber reinforced synthetic resin.

10. A device according to claim 7 in which the generator means is capable of generating a stream of water flowing at from about 2 to about 6 miles per hour.

11. A device according to claim 7 in which the generator means is capable of generating a stream of water flowing at from about 2 to about 8 miles per hour.

12. A device according to claim 10 in which the motor is capable of generating a thrust of from about 28 pounds to about 31 pounds.

13. A device according to claim 11 in which the motor is capable of generating a thrust of about 46 pounds.

14. A device according to claim 5 and further including means associated with the motor and propeller for influencing the water flowing under the action of the propeller toward a substantially laminar flow pattern, thereby minimizing helical and turbulent flow of said stream downstream of the propeller.

* * * * *